US008479957B2

(12) United States Patent
Ophardt

(10) Patent No.: US 8,479,957 B2
(45) Date of Patent: Jul. 9, 2013

(54) COMBINED TOILET PAPER AND FLUID DISPENSER

(75) Inventor: Heiner Ophardt, Vineland (CA)

(73) Assignee: Gotohti.com Inc., Beamsville (CA)

( * ) Notice: Subject to any disclaimer, the term of this patent is extended or adjusted under 35 U.S.C. 154(b) by 366 days.

(21) Appl. No.: 12/803,347

(22) Filed: Jun. 25, 2010

(65) Prior Publication Data

US 2011/0315715 A1 Dec. 29, 2011

(51) Int. Cl.
*B67D 7/58* (2010.01)

(52) U.S. Cl.
USPC ..... 222/192; 222/144; 242/597.5; 242/560.2

(58) Field of Classification Search
USPC ..... 222/192, 180, 181.3, 144, 321.7–321.9, 222/383.1, 383.3; 242/597.5, 560.2
See application file for complete search history.

(56) References Cited

U.S. PATENT DOCUMENTS

| | | | | | |
|---|---|---|---|---|---|
| 1,204,810 | A | * | 11/1916 | Mercer | 242/597.8 |
| 1,269,411 | A | * | 6/1918 | Edwards | 242/597.4 |
| 2,419,798 | A | * | 4/1947 | Stone | 242/571.5 |
| 2,472,239 | A | * | 6/1949 | Weller | 242/597.5 |
| 2,477,362 | A | * | 7/1949 | Cavalieri | 242/565 |
| 2,641,415 | A | * | 6/1953 | Moriarty | 242/597.8 |
| 2,746,798 | A | | 5/1956 | Wardell | |
| 3,079,099 | A | * | 2/1963 | Blain | 242/597.5 |
| 3,227,386 | A | * | 1/1966 | Pitcher | 242/597.5 |
| 3,495,571 | A | | 2/1970 | Evans | |
| 3,552,669 | A | * | 1/1971 | Earnest | 242/594.6 |
| 4,098,469 | A | | 7/1978 | McCarthy | |
| 4,108,513 | A | * | 8/1978 | Lander | 225/34 |
| 4,436,224 | A | * | 3/1984 | McInerny | 222/183 |
| 4,557,426 | A | * | 12/1985 | Siciliano | 242/560.3 |
| 4,667,846 | A | | 5/1987 | Marceau | |
| 4,901,889 | A | * | 2/1990 | Mitchell | 222/153.11 |
| 5,312,021 | A | | 5/1994 | Nelson | |
| 5,443,084 | A | | 8/1995 | Saleur | |
| 5,636,812 | A | * | 6/1997 | Conner et al. | 242/559.2 |
| 5,653,403 | A | * | 8/1997 | Ritchey | 242/597.5 |
| 5,671,872 | A | | 9/1997 | Daniels | |
| 5,819,989 | A | * | 10/1998 | Saraceni | 222/192 |
| 5,887,759 | A | | 3/1999 | Ayigbe | |
| 6,085,899 | A | | 7/2000 | Thorsbakken | |
| 6,138,874 | A | * | 10/2000 | Audrey | 222/192 |
| D464,874 | S | | 10/2002 | Tune et al. | |
| 6,457,434 | B1 | | 10/2002 | Lazar | |
| 6,497,345 | B1 | | 12/2002 | Wilker et al. | |
| 6,616,087 | B1 | * | 9/2003 | Chern | 242/559.2 |
| 6,786,448 | B2 | * | 9/2004 | Arcilesi | 242/597.4 |
| 6,918,513 | B1 | * | 7/2005 | Downey | 222/192 |
| 6,969,024 | B2 | * | 11/2005 | He et al. | 242/599 |
| 7,014,140 | B2 | * | 3/2006 | Elliott et al. | 242/559.2 |
| 7,185,841 | B2 | | 3/2007 | Kaufmann | |
| 7,318,949 | B2 | | 1/2008 | Shadrach | |

(Continued)

OTHER PUBLICATIONS

SanTRAL MRU—Dispenser for 4 Standard Toilet Rolls—Instruction Sheet Ophardt Hygiene-Technik GmbH & Co. KG—Germany.

*Primary Examiner* — Paul R Durand
*Assistant Examiner* — Donnell Long
(74) *Attorney, Agent, or Firm* — Thorpe North & Western LLP

(57) ABSTRACT

A toilet paper dispenser for dispensing toilet paper from a cylindrical roll of paper journalled about an axis and with a tubular member via which fluid is to be dispensed is positioned to extend parallel the axis.

12 Claims, 15 Drawing Sheets

U.S. PATENT DOCUMENTS

2007/0034650 A1* 2/2007 Pulch et al. ..... 222/192
2007/0290094 A1 12/2007 Anderson
2008/0011782 A1* 1/2008 Sidman ..... 222/192
2011/0139920 A1* 6/2011 Formon et al. ..... 242/559.2

* cited by examiner

COMBINED TOILET PAPER AND FLUID DISPENSER

SCOPE OF THE INVENTION

This invention relates to a dispenser for dispensing both toilet paper and a fluid and, more particularly, to an arrangement for providing a fluid dispenser for dispensing cleaning and/or disinfecting fluid in conjunction with a toilet paper dispenser.

BACKGROUND OF THE INVENTION

Toilet paper is well known as provided adjacent a toilet for use at the toilet as for cleaning and wiping with the toilet paper typically to be discarded via the toilet.

It is also known to provide proximate a toilet paper dispenser a fluid dispenser as to dispense liquid which can be applied to the toilet paper towards assisting in, for example, cleaning the surface of a toilet seat prior to use of the toilet.

Systems are known in which the toilet paper as it is dispensed is moistened with a fluid. Such previously known devices suffer the disadvantage that they are relatively complex and therefore are expensive and subject to failure.

SUMMARY OF THE INVENTION

To at least partially overcome these disadvantages of previously known devices, the present invention provides a toilet paper dispenser for dispensing toilet paper from a cylindrical roll of paper journalled about an axis and with a tubular member via which fluid is to be dispensed is positioned to extend parallel the axis.

An object of the present invention is to provide a simplified arrangement for a toilet paper dispenser which incorporates a fluid dispenser.

Another object is to provide an inexpensive arrangement for a combination of a fluid dispenser and a toilet paper roll holder adapted to hold a cylindrical roll of paper disposed about an axis.

The present invention preferably provides in combination a fluid dispenser and a toilet paper roll holder. The toilet paper roll holder is adapted to hold a cylindrical roll of paper disposed about an axis. The fluid dispenser preferably comprising a container and a pump mechanism activatable to dispense fluid from the container out a dispensing outlet. Fluid is preferably dispensed from one side of the paper roll via a tubular member which extends parallel the axis. The container preferably has a portion, preferably cylindrical, disposed about the axis and an outlet at one axially end of the container. The pump mechanism is coupled to the container across the outlet. The roll of paper is preferably coaxially about the cylindrical portion of the container.

In one aspect, the present invention provides a toilet paper dispenser comprising:

in combination, a liquid dispenser and a toilet tissue roll holder adapted to hold a cylindrical roll of paper disposed about a hollow center support tube of the holder, the hollow center support tube including a cylindrical portion of a container for fluid having an outlet at one distal axial end of the tube, a pump mechanism carried on the distal end accessible at the distal end on one side of the roll and manually activatable to dispense fluid in the container out the outlet.

In another aspect, the present invention provides in combination, a toilet paper roll holder and a fluid dispenser, the fluid dispenser comprising a container and a pump mechanism with a dispensing outlet, the container having an elongate cylindrical portion with an outer surface which is cylindrical about a central axis, the cylindrical portion having a distal end and a proximal end, the container having an outlet at the distal end, the pump mechanism coupled to the container across the outlet at the distal end, the pump mechanism having an activator accessible at the distal end of the cylindrical portion for engagement manually by a user to activate the pump to dispense fluid from the container out the dispensing outlet, a mounting mechanism securely supporting the container maintaining the axis generally disposed horizontally and with the proximal end engaged by the mounting mechanism and the distal end extending away from the mounting mechanism, a toilet paper roll comprising an elongate sheet of paper sheet wound about a hollow central cylindrical core, in a engaged position, the cylindrical portion of the container is received substantially coaxially inside the hollow core and the core is journalled coaxially about the cylindrical portion of the container for rotation of the roll about the axis, in the engaged position, the actuator of the pump mechanism accessible by a user axially at the distal end, axial sliding of the roll relative the cylindrical portion of the container while maintaining the core coaxial with the axis permitting movement of the roll from a disengaged position relative the roll to the engaged position.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
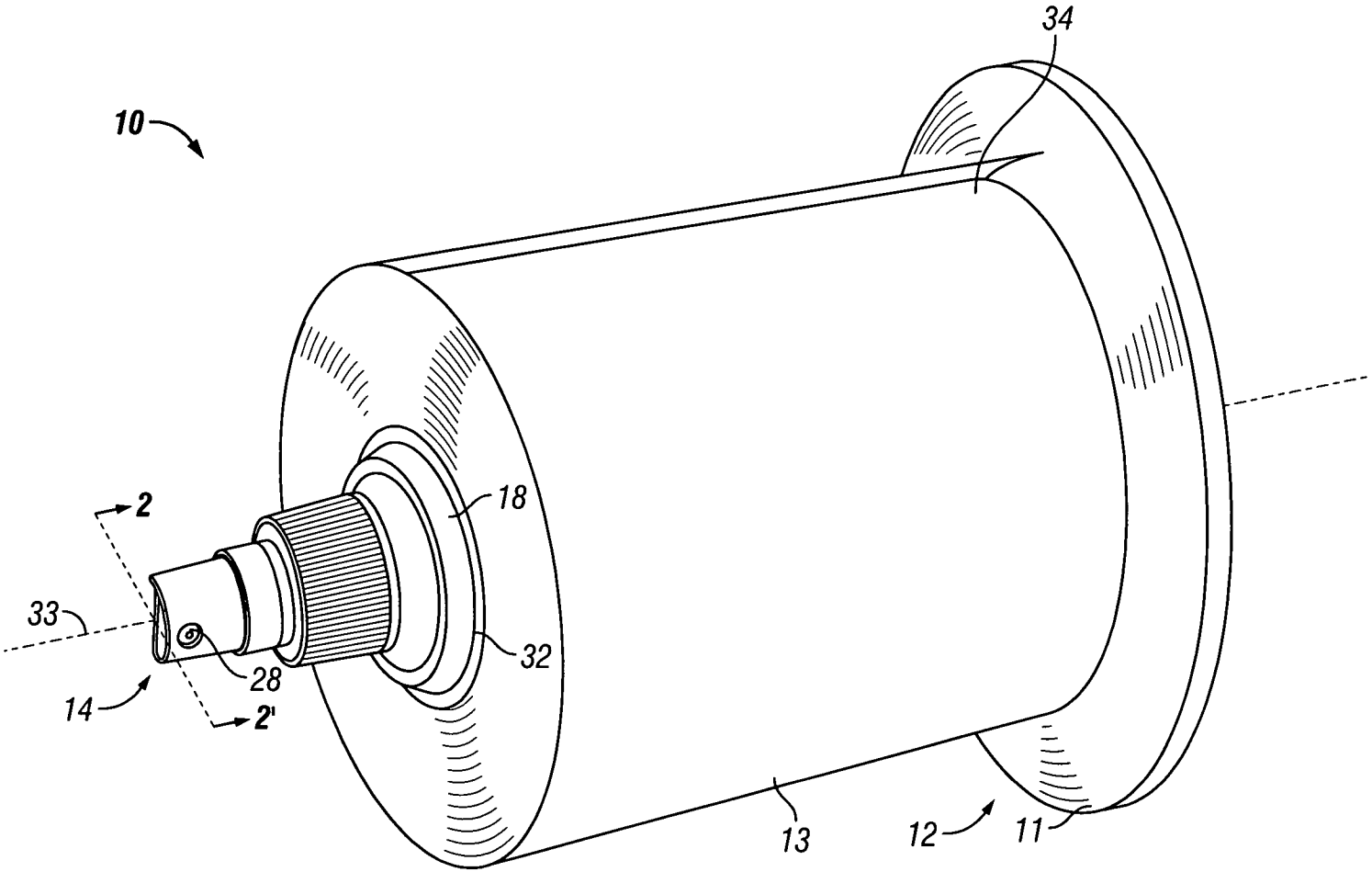
FIG. 1 is a perspective view from below of a toilet paper dispenser in accordance with a first embodiment of the present invention.
Figure 2:
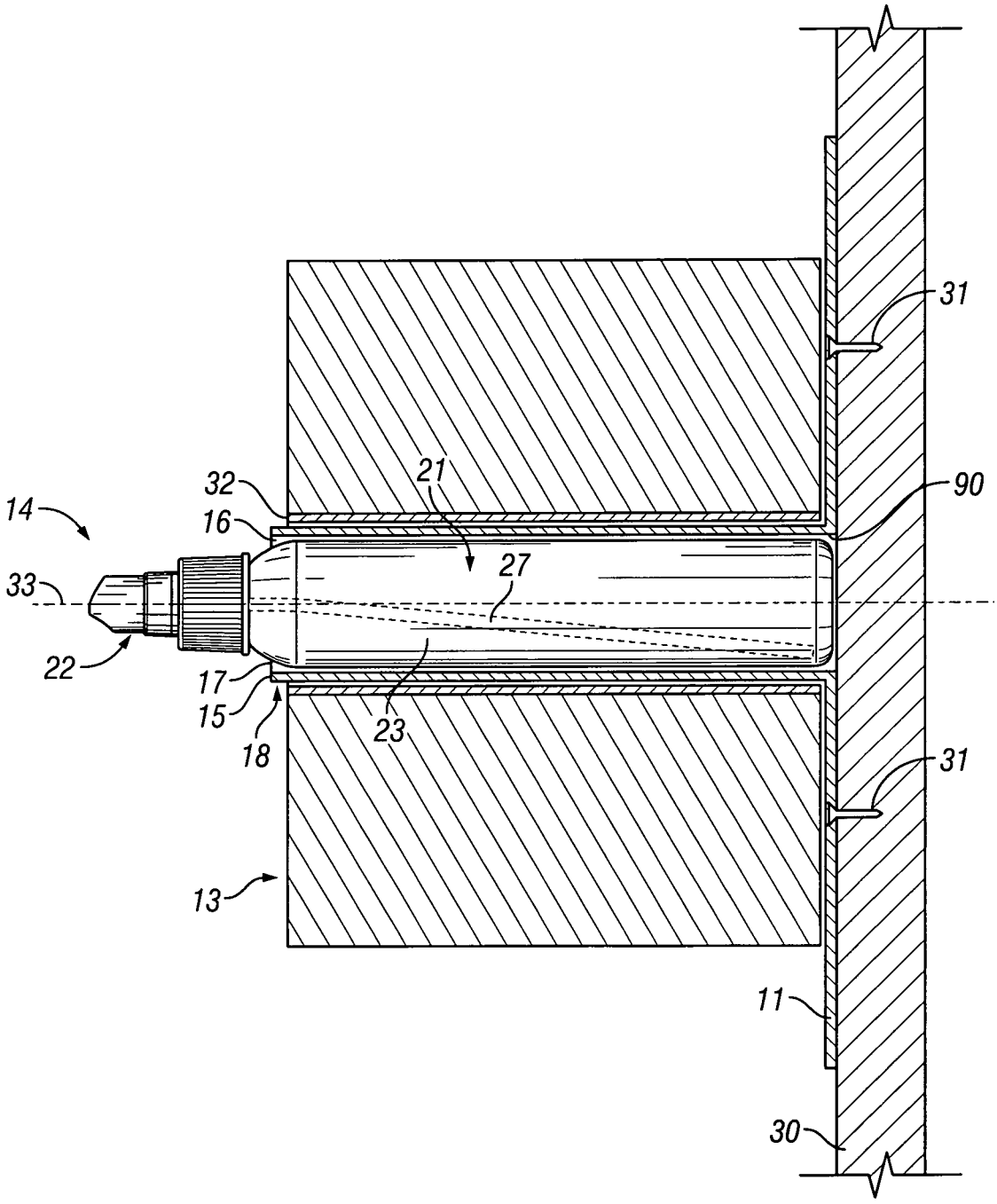
FIG. 2 is a vertical cross-sectional view of the dispenser of FIG. 1 along a vertical section line indicated as 2-2' in FIG. 1.
Figure 3:
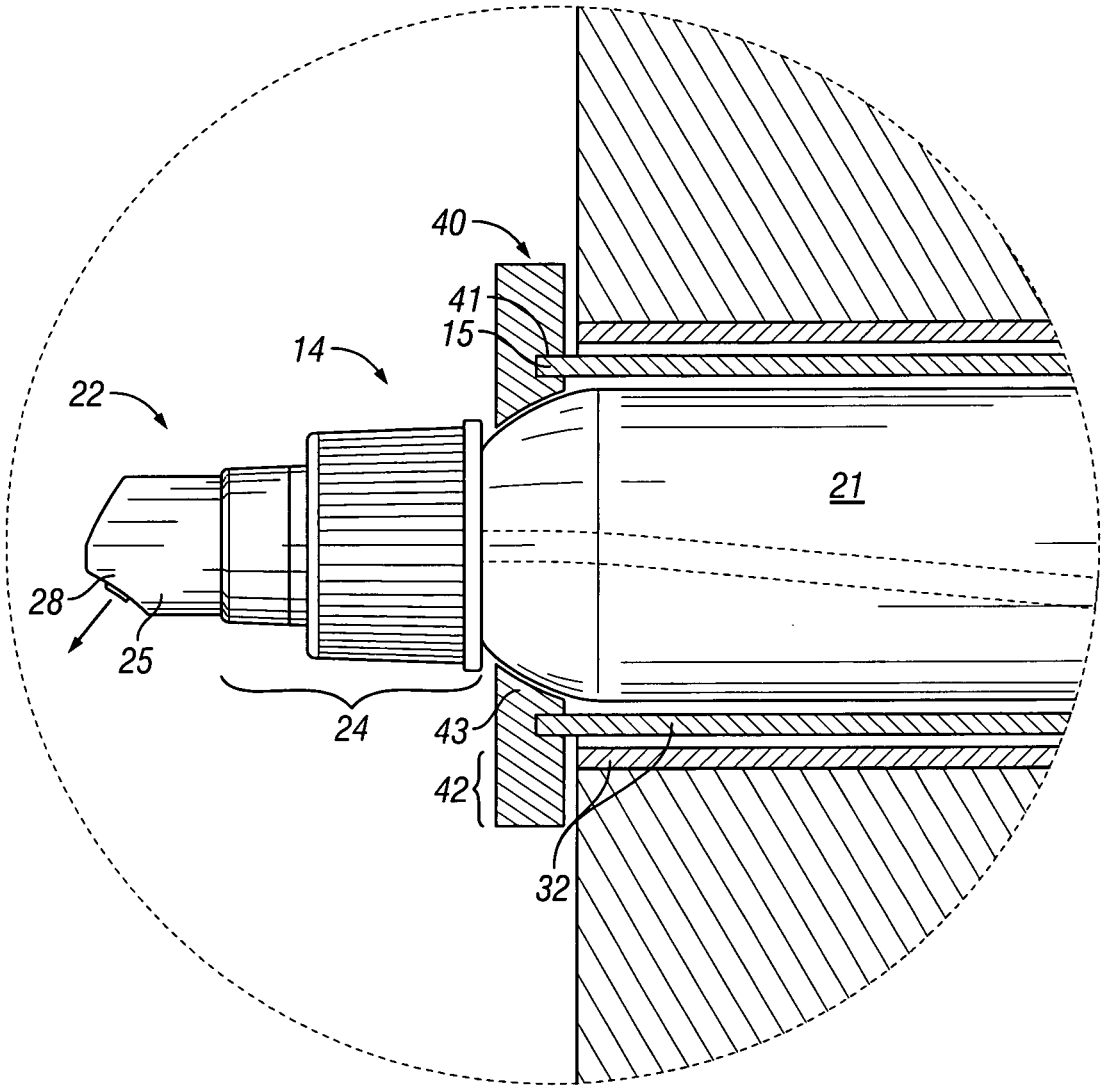
FIG. 3 is a side view the same as FIG. 2 but showing merely a portion of FIG. 2 and including additionally a securing ring.

Reference is made first to FIGS. 1 to 3 which shows a first embodiment of a dispensing apparatus 10 in accordance with the present invention. The dispensing assembly 10 comprises a paper dispenser 12 and a fluid dispenser 14. The paper dispenser 12 comprises a circular planar support plate 11 to which a cylindrical center tube 18 is fixedly secured. The center tube 18 is coaxial about a central axis 33 normal to the support plate 11 and extending through a center of the support plate 11. The center tube 18 has a proximate or rear end 90 and is open at a distal front end 15 defining a cylindrical cavity 16 therein open forwardly through an opening 17 at the front end 15 of the tube. As seen in FIG. 2, the support plate 11 is adapted to be mounted to a vertical wall 30 as by screws 31. A conventional toilet paper roll 13 is shown mounted on the paper dispenser 12. The paper roll 13 comprises a roll core 32 about which a thin sheet of paper is helically wound presenting a distal end 34 which can be grasped by a user and a portion of the paper sheet removed from the distal end 34 for use. In the preferred embodiment shown, the paper roll 13 has its roll core 32 disposed about the center tube 18 such that the paper roll 13 may rotate about the center tube 18 to assist in dispensing paper by a user grabbing and pulling on the distal end 34 of the paper sheet.

The fluid dispenser 14 comprises a fluid container 21 and a pump mechanism 22. The container 21 has a generally cylindrical body portion 23 best seen in FIG. 2 closed at an inner end and open at an outer end through a neck. The pump mechanism 22 is secured to the neck of the container 21 and is of a type which can be manually engaged to dispense fluid from the bottle. Such pump mechanisms 22 are well known to persons skilled in the art and they typically have a piston chamber forming portion 24 secured to the neck of the bottle and a piston portion 25 slidably mounted thereto whereby manual sliding of the piston element 25 axially inwardly into the piston chamber forming portion 24 draws fluid from inside the container 21, typically through a dip tube 27 schematically shown in dashed lines in FIG. 2 for dispensing fluid out an outlet 28 best seen in FIG. 1 carried on the piston element 25. As seen in FIG. 3 in a manner which differs slightly from that shown in FIG. 1, the dispensing outlet 28 is a nozzle generally directed vertically downwardly and angled away from the wall 30 as is preferred.

The paper roll 13 is removably mounted on the paper dispenser 12. In this regard, the paper roll 13 may be slid axially forwardly to become disengaged from the center tube 18 for replacement with a replacement paper roll 13 as, for example, when the paper roll is entirely used up.

The fluid dispenser 14 is also removably mounted to the paper dispenser 12. In the embodiment illustrated in FIGS. 1 and 2, the fluid dispenser 14 can be slid axially into and out of the center tube 18 through the front open end 15 of the tube 18.

Reference is made to FIG. 3 which shows a portion of FIG. 2 enlarged for ease of illustration. FIG. 3 differs from FIG. 2 in that a securing ring 40 is provided secured in a snap friction type fit onto the front end 15 of the tube 18 by reason of an annular circular channel 41 of the ring 40 engaging a front end of the tube 15. The securing ring 40 has an outer portion 42 which extends radially outwardly from the center tube 18 sufficiently so as to prevent the roll core 32 from being slid off the center tube 18 while the securing ring 40 is in place. The securing ring 40 also has an inner portion 43 which extends radially inwardly sufficiently that the inner portion 43 lies forwardly of a shoulder portion of the container 21 and prevents axial sliding of the fluid dispenser 14 outwardly from the center tube 18 while the securing ring 40 is in place. Removal of the securing ring 40 permits either the paper roll 13 to be moved and replaced or the fluid dispenser 14 to be removed and replaced.

In use of the dispensing apparatus 10 as illustrated in FIGS. 1 and 2, it may be desired to permit a user to remove the fluid dispenser 14 from the paper dispenser 12 in normal use as, for example, to spray fluid directly onto the seat of a toilet or onto a sheet of paper which has been removed from the paper roll 13. With the embodiment shown in any one of FIGS. 1 to 3, with the fluid dispenser 14 in place within the center tube 18, it is possible for a user to activate the fluid dispenser 14 while it is retained inside the center tube 18 such that a detached sheet of the paper may, for example, be held below the outlet 28 of the pump mechanism 22 and have fluid sprayed onto the sheet of paper.

The embodiment of FIG. 3 is intended for use with the securing ring 40 in place so as to require the fluid dispenser 14 to be utilized while it is retained secured within the center tube 18 of the paper dispenser 12.

Figure 4:
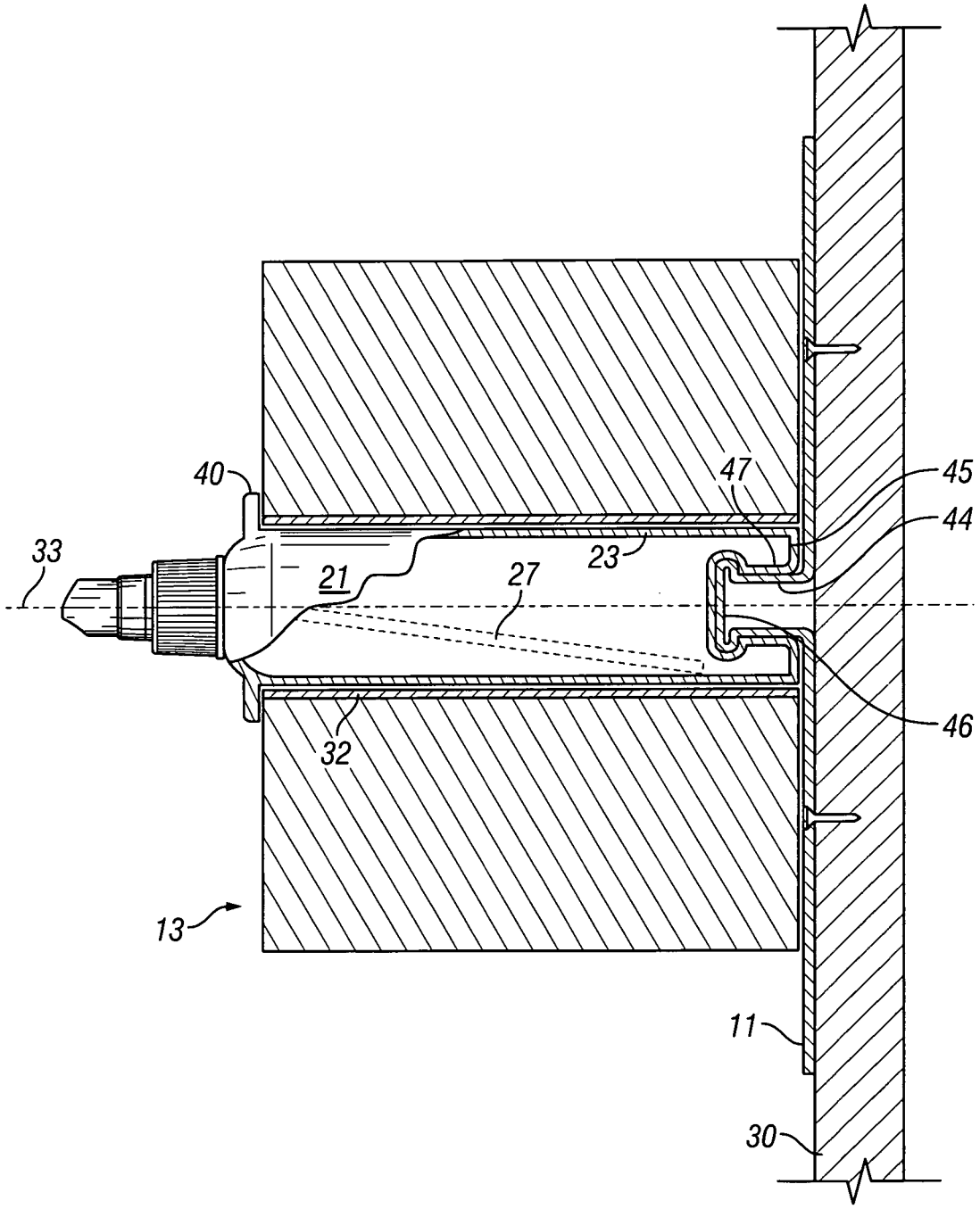
FIG. 4 is a side view the same as FIG. 2, however, showing a second embodiment of a dispenser in accordance with the present invention.

Reference is made to FIG. 4 which shows a second embodiment of a dispensing assembly 10 in accordance with the present invention. In each of the embodiments, similar reference numerals are used to refer to similar elements. In FIG. 4, the container 21 is removably coupled at its rear to the support plate 11. The cylindrical portion 23 of the container 21 is disposed directly inside the roll core 32 and the paper roll 13 thus is journalled for rotation about the cylindrical portion 23 of the container 21.

The fluid dispenser 14 in FIG. 4 is identical to the fluid dispenser described in FIGS. 1 to 3 with two exceptions. Firstly, as one manner of coupling the container 21 to the support plate 11, the support plate is provided about the axis 33 with a forwardly extending male member 44 which extends forwardly from the support plate 13 to an enlarged annular forward end 46. The container 21 has at a rear end 45 an axially and forwardly inwardly extending female recess 47 with an enlarged forward end. The female recess 47 is adapted to engage the male element 44 in a friction, snap-fit so as to fixedly but removably secure the container 21 to the support plate 11 with the container 21 extending rigidly forwardly coaxially about the axis 33 normal the support plate 11.

The container 21 is illustrated as carrying an annular retaining ring or collar 40 which extends radially outwardly past the tube core 32 so as to retain the paper roll 13 about the cylindrical portion of the container 21 against removal. In FIG. 4, the retaining collar 40 is integrally formed with the container 21 although it could be modified to be removable from the bottle. In the embodiment illustrated in FIG. 4, the paper dispenser 12 has avoided the need for a separate center tube 18 provided in the embodiment of FIGS. 1 to 3.

Figure 5:
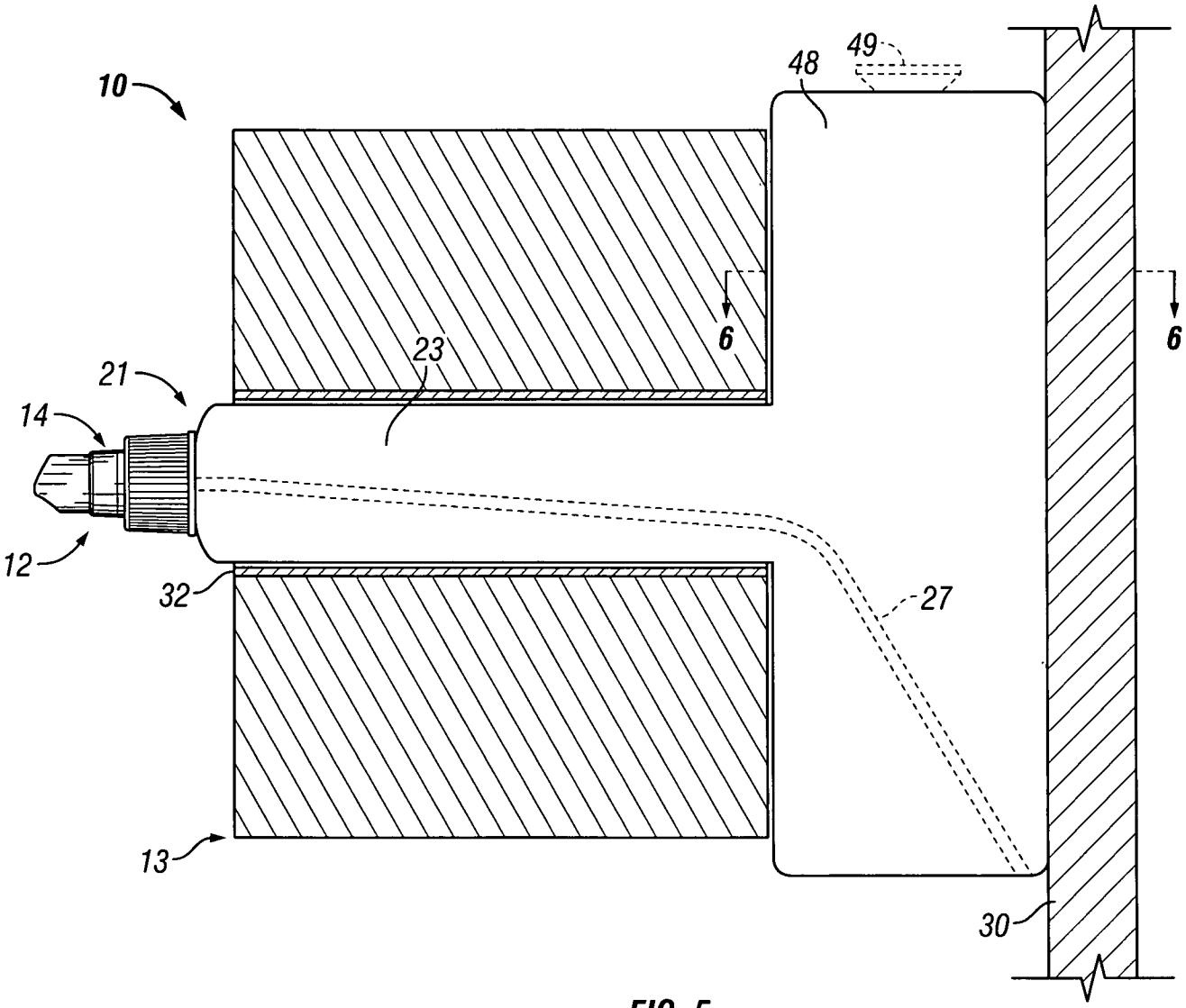
FIG. 5 is a cross-sectional view the same as FIG. 2 but showing a third embodiment of a dispenser in accordance with the present invention.
Figure 6:
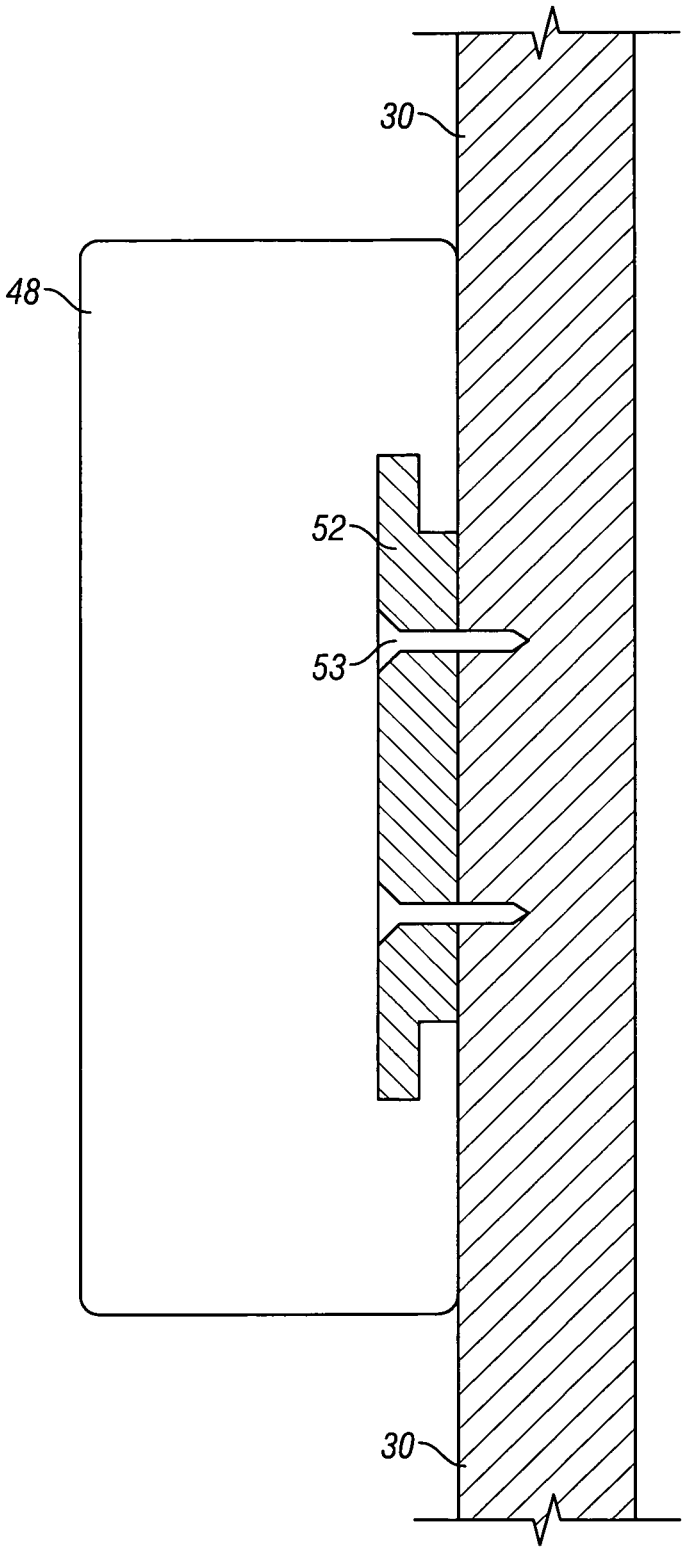
FIG. 6 shows a horizontal cross-sectional view along section line 6-6' in FIG. 5.
Figure 7:
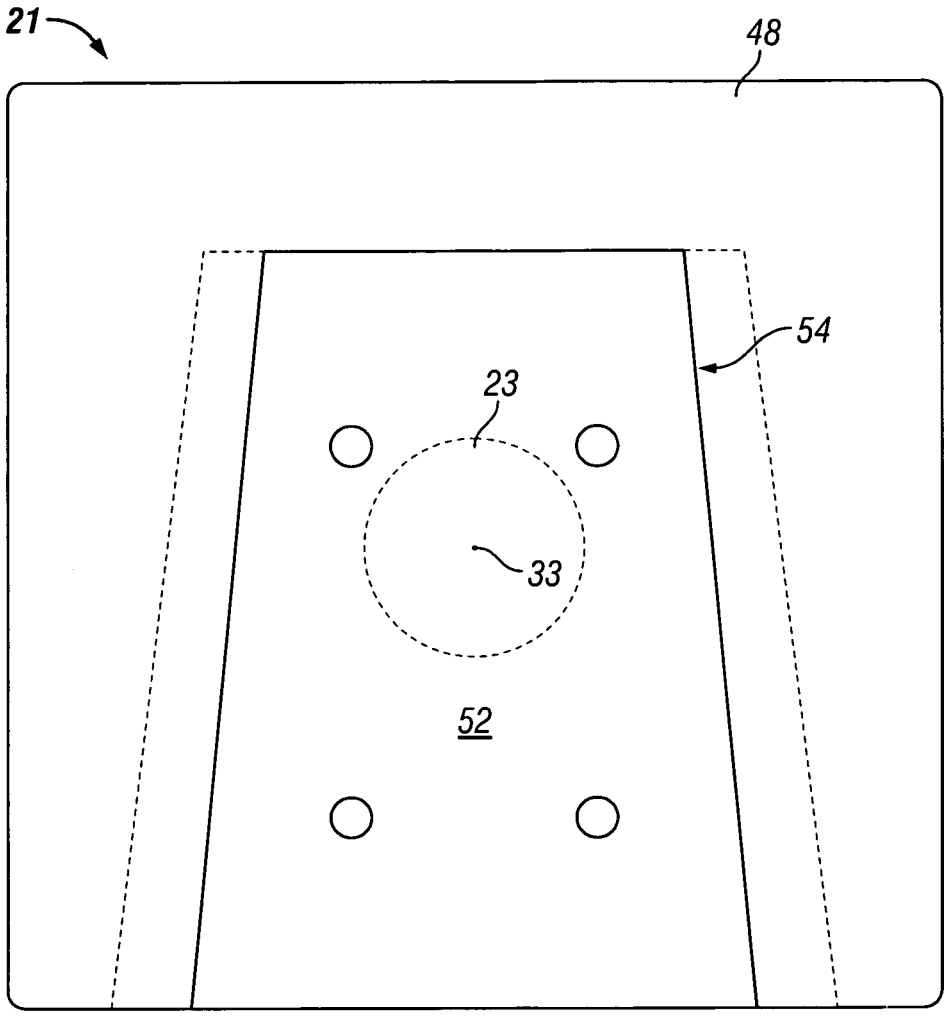
FIG. 7 is a plan view showing the back of the dispenser of FIGS. 5 and 6.

Reference is now made to FIGS. 5 to 7 which show a third embodiment of a dispensing apparatus in accordance with the present invention.

In FIG. 5, the container 21 includes not only the cylindrical portion 23 but also a rear mounting portion 48 which, as can be seen from FIG. 7 in rear view, has the shape of a square and the cylindrical portion 23 of the container 21 would be disposed about its axis 33 centered on the diagonals of this square and extending normal to the plane of FIG. 7. As best seen in FIG. 5, the mounting portion 48 has a relatively substantial volume and serves to increase the overall volume of fluid which can be retained within the container 21. As schematically illustrated in FIG. 5 in dashed lines, a secondary opening may be provided in the top surface of the mounting portion 48 closed by a removable cap 49 as to assist in filling the container 21 without its removal from the wall although this is not necessary. In FIG. 5, the paper roll 13 is shown as journalled about the cylindrical portion 23 of the container 21 axially forwardly of the mounting portion 48. As one simple manner of mounting the container 21 to the wall 30, a triangular dovetailed mounting plate 52 is shown secured to the wall via screws 53. The mounting portion 48 carries at its rear a downwardly opening and downwardly widening slot 54 which is dovetailed so as to match the mounting plate and permit the container 21 to be fixedly secured by mere sliding of the container downwardly onto the mounting plate 52. The container 21 illustrated in FIGS. 5 to 7 can be manufactured as a unitary piece as by blow moulding.

Figure 8:
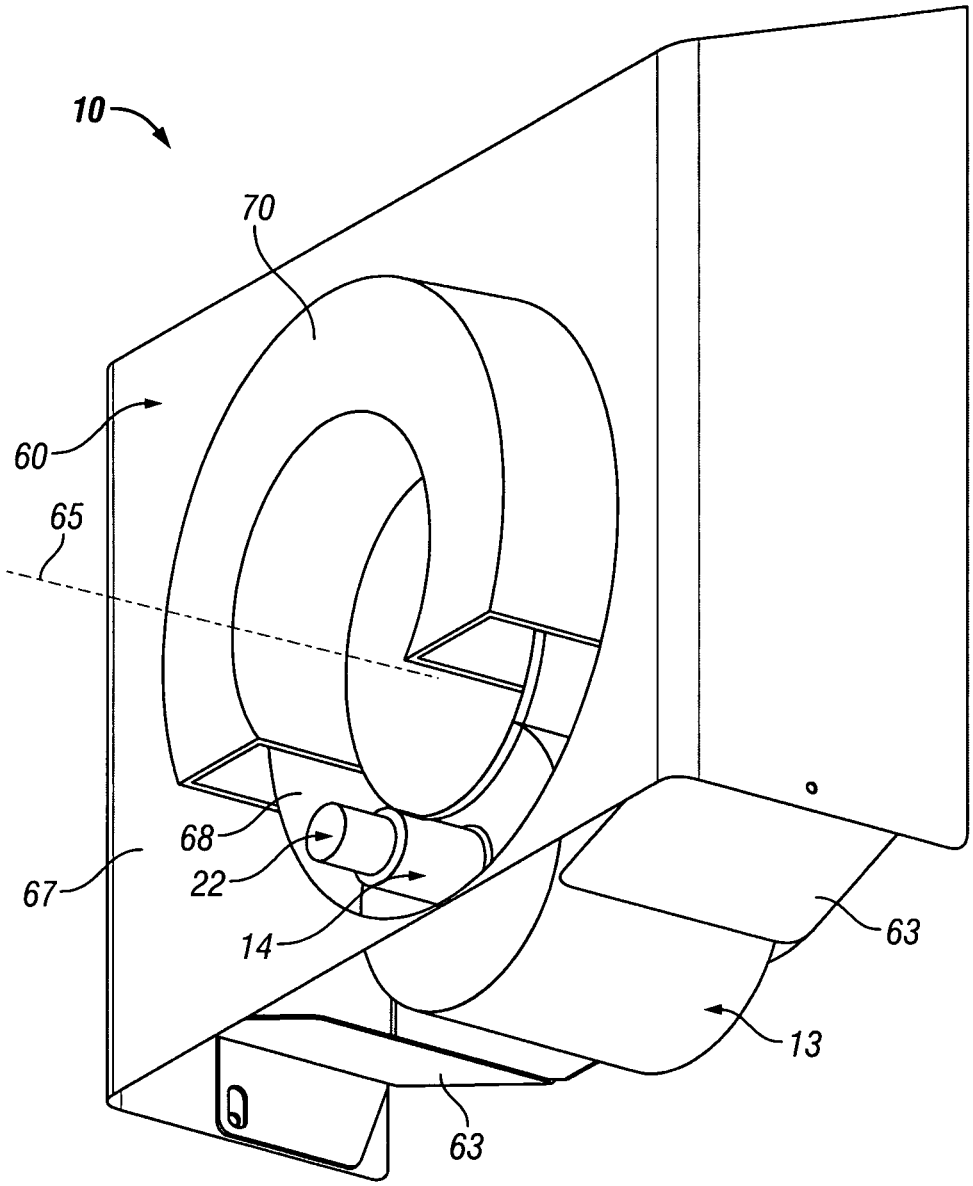
FIG. 8 is a front perspective view of a fifth embodiment of a dispenser in accordance with the present invention.
Figure 9:
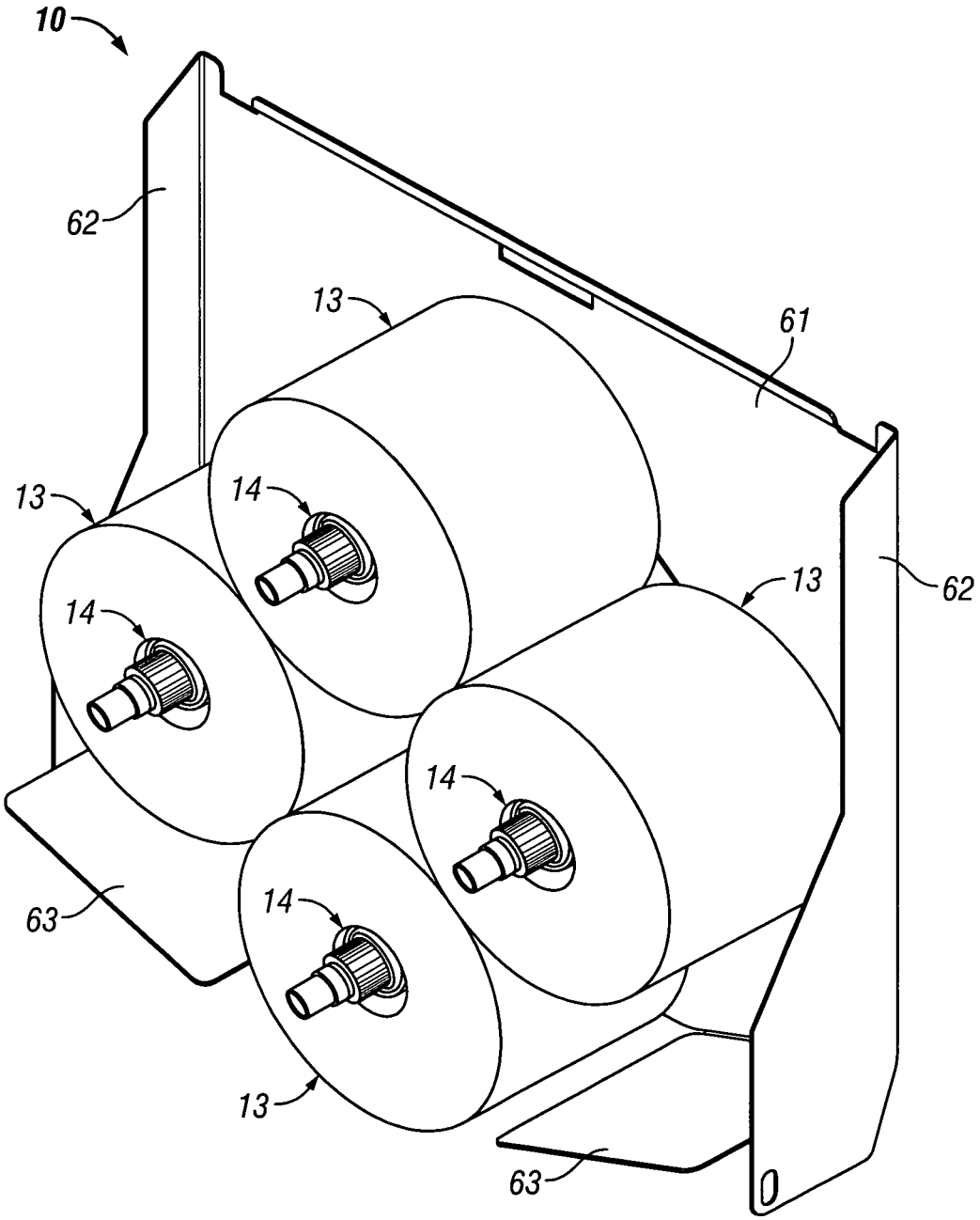
FIG. 9 is a front perspective view of the dispenser shown in FIG. 8, however, with the cover removed.
Figure 10:
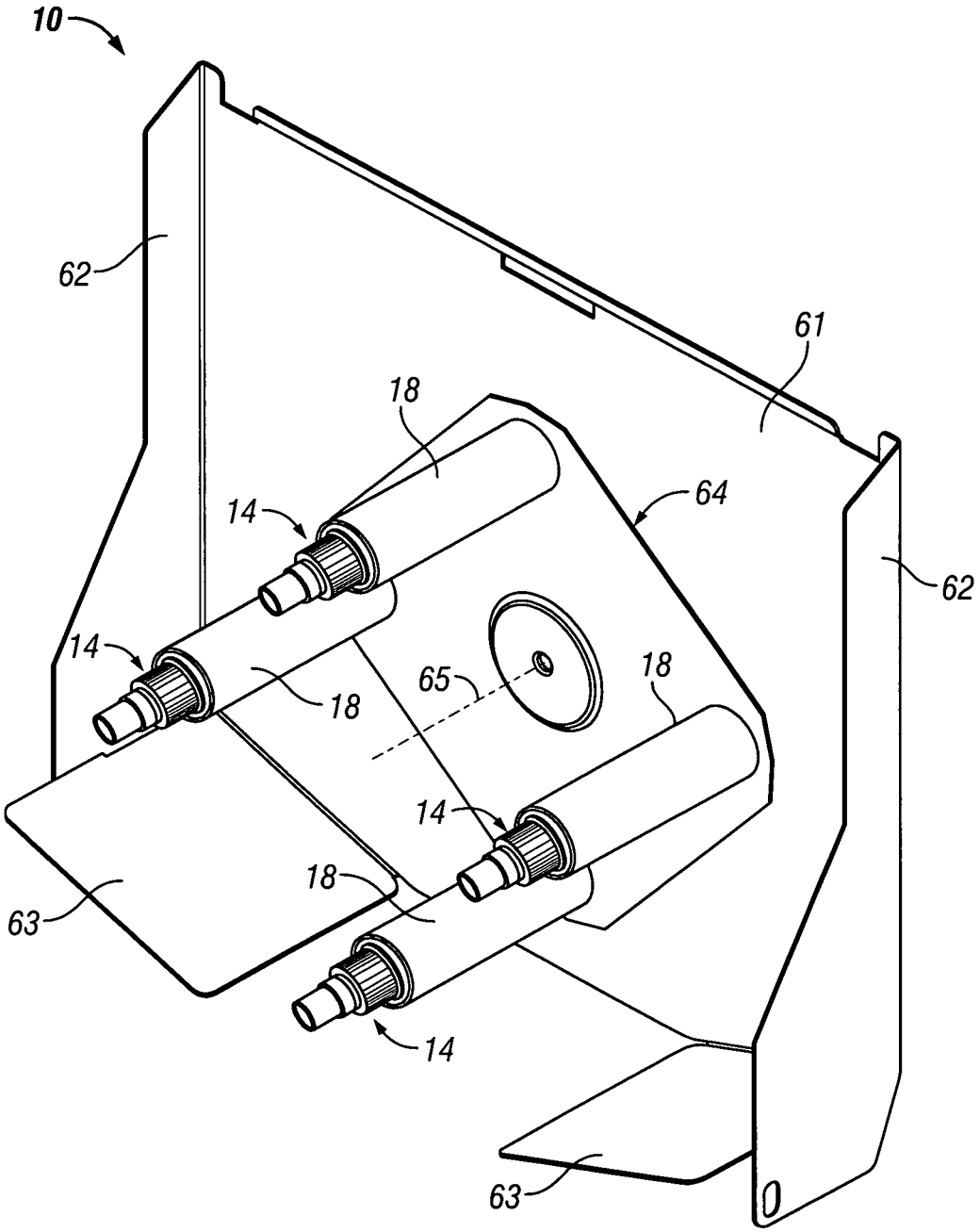
FIG. 10 is a perspective view the same as shown in FIG. 9 but with the toilet paper rolls removed.

Reference is made to FIGS. 8 to 10 which show a fifth embodiment of a dispensing apparatus 10 in accordance with the present invention. The apparatus shown in FIGS. 8 to 10 is a modification of a known carousel paper dispenser. As best seen in FIG. 10, the paper dispenser 12 has a backplate 61, two side plates 62 and two bottom plates 63. A turntable 64 is fixedly secured to the backplate 61 journalled for rotation about a turntable axis 65. The turntable 64 carries four center tubes 18. Each center tube 18 is adapted to receive a paper roll 13 thereabout. As well, each center tube 18 is adapted to receive a fluid dispenser 14 therein which for the purposes of FIG. 10 may be assumed to be identical to the dispenser 14 shown in FIGS. 1 and 2. In a known manner, the turntable 64 is rotatable about the turntable axis 65 so as to locate one of the paper rolls 13 in a bottom-most position disposed between the bottom plates 63 such that paper on the bottom roll 13 is accessible for use. When the paper on one roll may be exhausted, rotation of the turntable 64 about the turntable axis 65 will present a remaining one of the paper rolls 13 on another of the center tubes 18 at the bottom-most position and accessible by a user. As seen in FIG. 8, a cover 60 is provided which is adapted to be secured to the side plates and backplate to prevent undesired access to the turntable 64. The cover 60 is configured so as to provide access merely to the fluid dispenser 14 carried in the center tube 18 in the bottom-most position. In this regard, the cover 60 has a front plate 67 with an annular slot 68 cut therefrom disposed circumferentially about the turntable axis 65 and with an annular shroud 70 extending forwardly to cover an uppermost portion of the annular slot 68 yet leave the annular slot open throughout a lowermost portion of the annular slot. The forwardmost portions of the pump mechanism 22 of each fluid dispenser 14 extends forwardly via the annular slot 68 through the plate 67 but only the fluid dispenser 14 in the bottom-most position is accessible below the shroud 70. The pump mechanism 22 coaxially within the lowest-most paper roll 13 is accessible to a user whereas the pump mechanisms 22 received in the center tubes 18 of the three uppermost paper rolls 13 are not accessible. With rotation of the turntable 64 to place a different paper roll 13 in the bottom-most position, the fluid dispenser 14 carried in the center tube 18 associated with that paper roll 13 will also be moved to a position where it can be engaged by a user.

Figure 11:
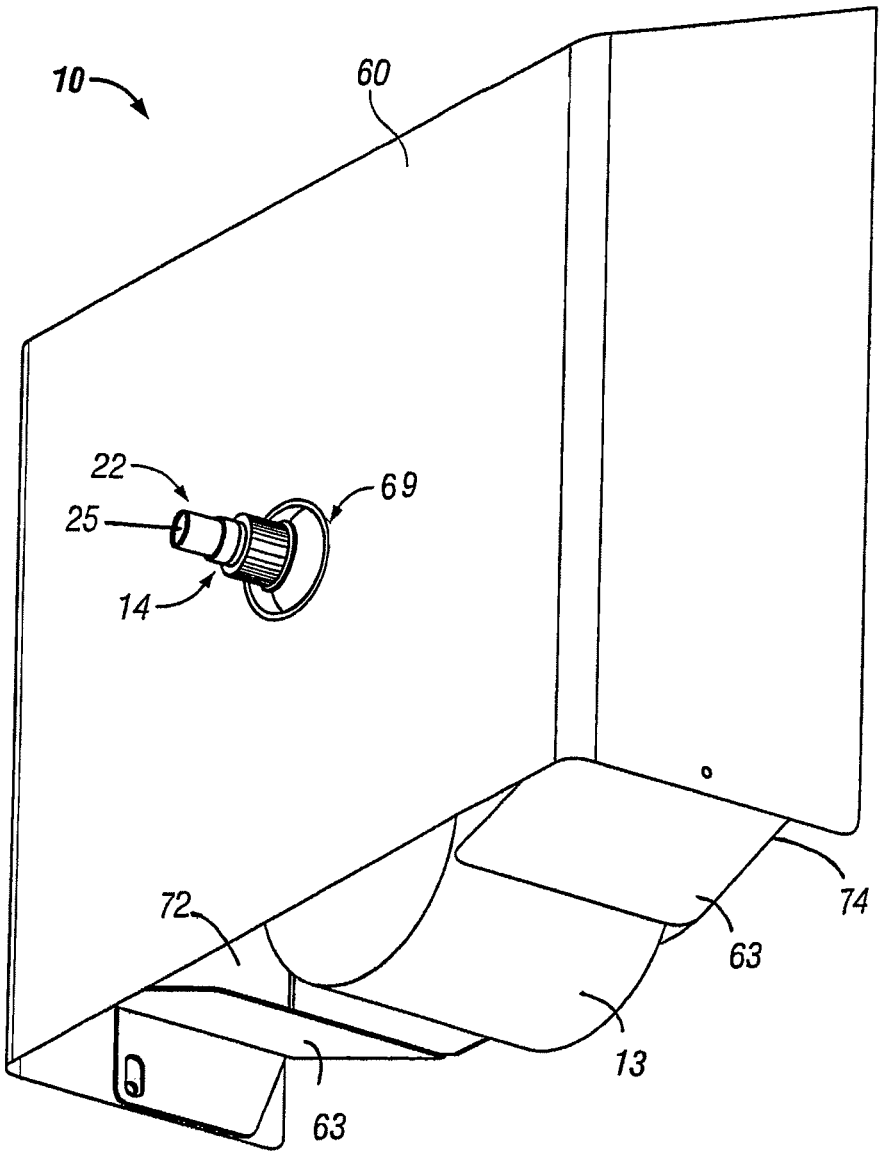
FIG. 11 is a perspective view of a sixth embodiment of a dispenser in accordance with the present invention.
Figure 12:
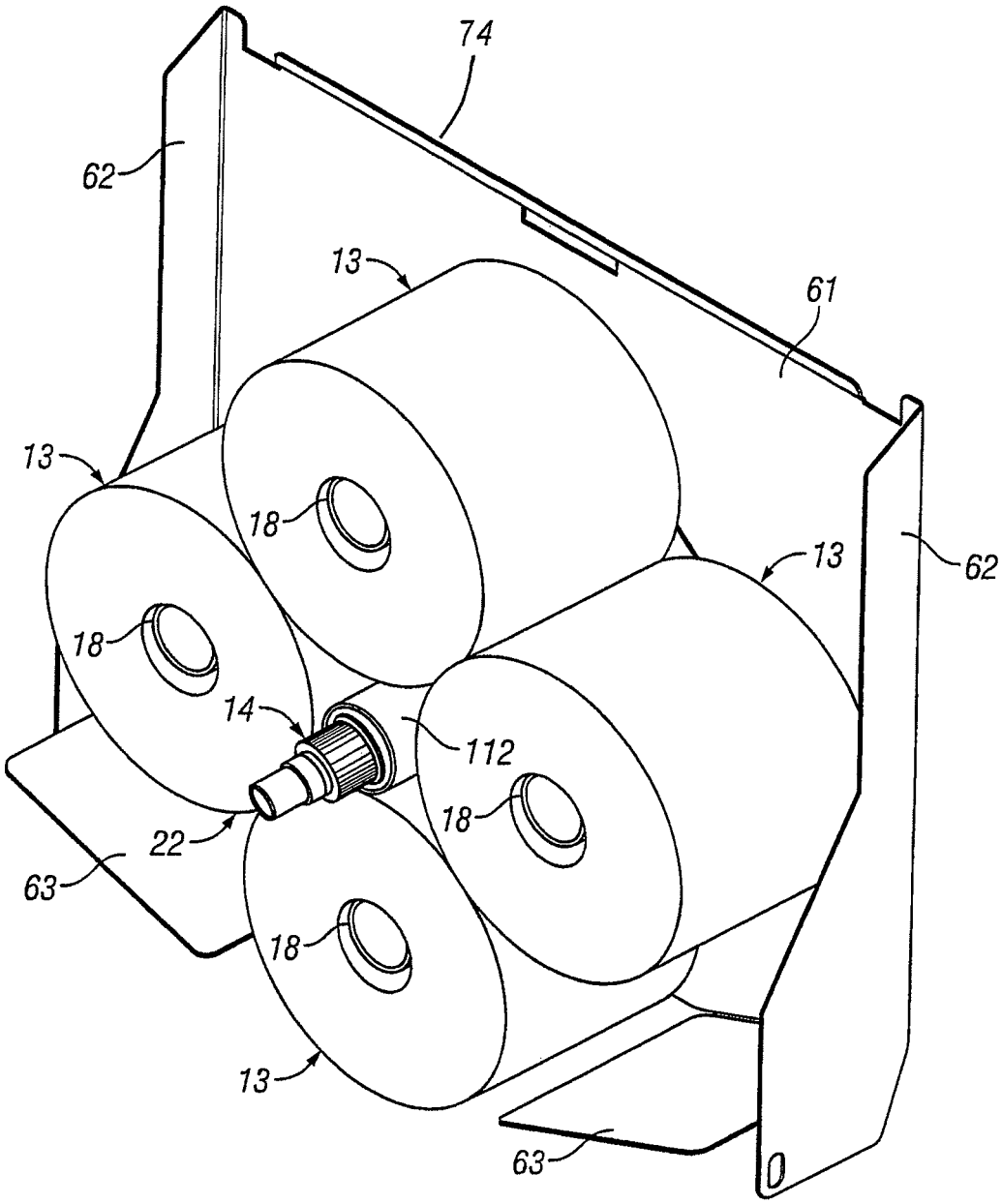
FIG. 12 is a perspective view showing the dispenser of FIG. 11 but with its cover removed.
Figure 13:
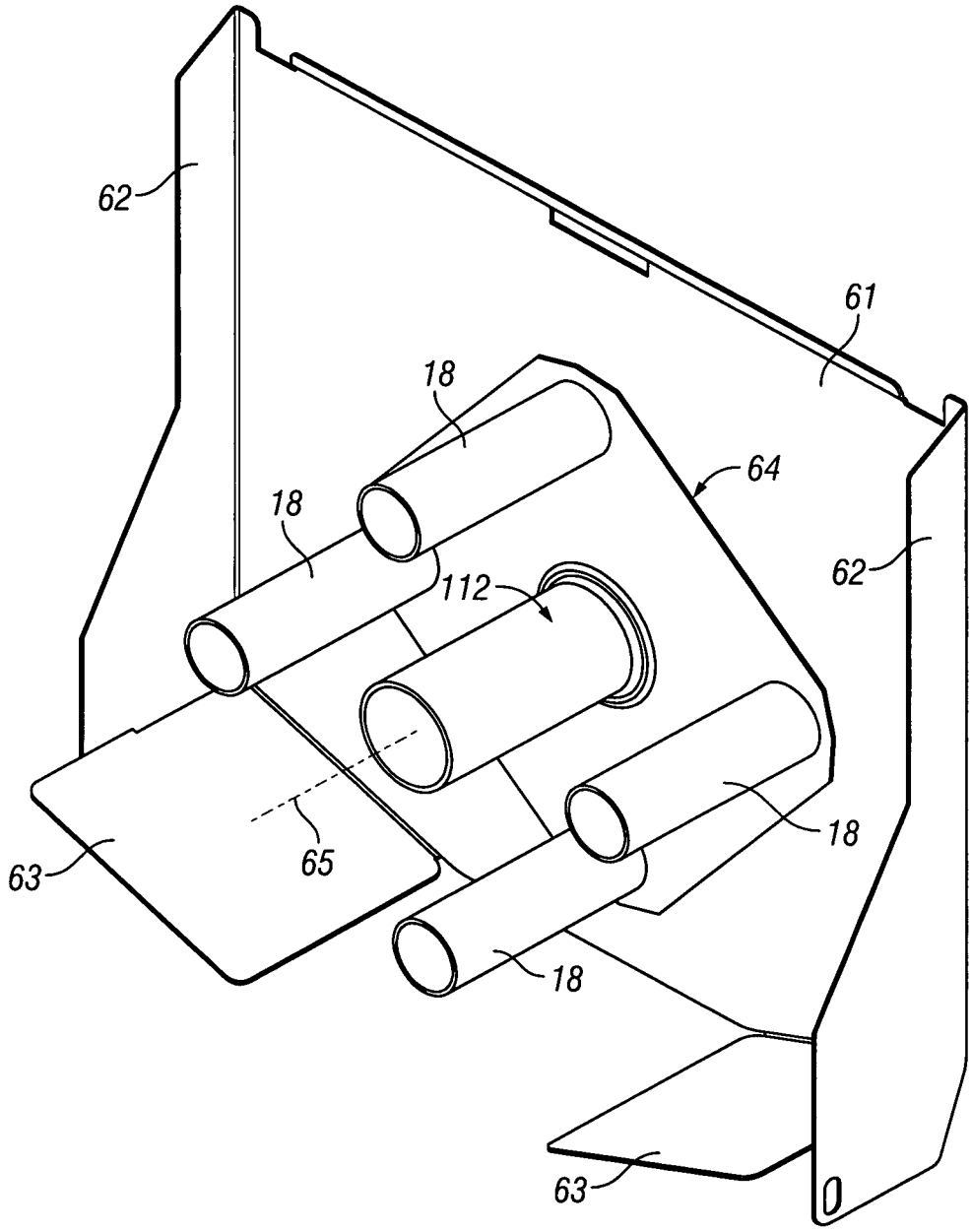
FIG. 13 is a perspective view of the dispenser of FIG. 12 with the toilet paper rolls and the liquid dispenser container removed.

Reference is made to FIGS. 11 to 13 which illustrate a sixth embodiment of a dispensing apparatus 10 in accordance with the present invention. The dispensing apparatus 10 illustrated in FIGS. 11 to 13 has similarities to the fifth embodiment illustrated in FIGS. 8, 9 and 10. As seen in FIG. 12, the dispensing apparatus has a housing 74 formed by the backplate 61, two side plates 62 and two bottom plates 63. Referring to FIG. 13, the turntable 64 has been modified as to provide an additional tube 112 fixedly secured to the turntable 64 coaxial about the rotation axis 65 which serves as a container mounting mechanism for the fluid disperser. As seen in FIG. 12, a fluid dispenser 12 is shown to be received inside the tube 112 with its pump mechanism 22 extending axially forwardly therefrom. As seen in FIG. 12, a paper roll 13 is shown disposed on each of the four center tubes 18. Each of the four center tubes 18 is, as best seen in FIG. 13, spaced radially from the turntable axis 65 in a spaced circular array circumferentially spaced from each other. As seen in FIG. 11, the cover 60 is provided with a central opening 69 therethrough through which when the cover 60 is mounted to the housing 74 in a closed position as in FIG. 11, the pump mechanism 22 of the fluid dispenser 14 may extend for manual access and use of the piston element 25 which serves as a manually movable actuator to dispense fluid. By selecting the relative size of the opening 69 through the cover 60, the fluid dispenser 14 may, with the cover 60 secured in place, either be prevented from being removed axially from the tube 112, as seen in FIG. 11, or may be permitted to be slid axially from the tube 112. As can be seen in FIG. 11, the cover 60 has a paper access opening 72 which opens downwardly and is radially spaced from the central opening 69 relative the turntable axis 65. When the cover 60 is in a closed position as seen in FIG. 11, rotation of the turntable successively moves each holder to a lowest-most position in which a paper roll 13 on that holder is accessible for engagement by a user through the paper access opening 72 and between the bottom plates 63, and the other paper rolls on the turntable are not accessible for engagement by a user. When the cover 60 is in an open position, such as when removed as seen in FIG. 12, the fluid dispenser 14 can be manually removed from or engaged on the tube 112 by horizontal sliding and each paper roll 13 can be manually removed from or engaged on the center tubes 18 by horizontal sliding.

The present invention illustrates providing in certain of the embodiments a toilet paper roll 13 wound about a cylindrical central roll core 32 and with a fluid dispenser 14 disposed to extend coaxially within the core 32 and present a dispensing outlet 28 axially at one side of the paper roll 13. In the simplified arrangement in FIG. 1, there is no cover about the paper. In the more complex arrangement shown in FIGS. 8 and 11, a cover is provided about multiple paper rolls 13. It is to be appreciated that a housing illustrated as, for example, in FIG. 11 could be provided on a paper dispenser having but a single roll as, for example, in a fixed location within the housing. Alternatively, there may be more than one roll fixedly located within the housing with each fluid dispenser 14 to extend through a respective fixedly located opening in the cover. Insofar as the paper rolls may be movable from one location to another within the housing as, for example, by sliding from one storage position to another storage position, suitable modifications of the cover may be provided for covering the pump mechanisms 22 of fluid dispensers 14 associated with paper rolls 13 when such paper rolls are not accessible for use and exposing ready for access the pump mechanism 22 of any fluid dispenser 14 associated with a paper roll which is accessible for use.

In each of the embodiments illustrated in FIGS. 1 to 10, the paper roll 13 is in an engaged position journalled for rotation about an axis coaxially about a container 21. Each of the paper rolls 13 is removable from being disposed substantially coaxially about the container 21 by relative axial sliding of the paper roll 13 relative the cylindrical portion of the container while maintaining the roll core 32 coaxial with the axis 33. In the case of the embodiments illustrated in FIGS. 1, 5 and 8, the paper roll 13 may be slid over the distal end of the container 21 and, in these embodiments, it is preferred that the fluid dispenser have in an axial direction forward of the paper roll 13 a radius about the axis 33 which is less than the radius of the roll core 32.

In contrast, in the embodiment of FIG. 4, if the retaining flange 40 is integrally formed as a portion of the container 21, then removal of a paper roll 13 will require disengagement of the container 21 from the support plate 11 and then axial sliding of the roll off the proximate end of the container 21. The embodiment of FIG. 4 may be modified such that the retaining flange 40 shown as an integral part of the container 21 may be formed to be removably secured thereto as, for example, being secured to the pump mechanism 14 or container 21 as in a removable threaded arrangement or snap-fit arrangement in which case the container 21 would not need to be removed from the support plate 11 to apply a new roll.

It is preferred that the pump mechanism 22 dispense fluid downwardly from the outlet 28. As a result, it is desired that the pump mechanism 22 be secured in an arrangement with the outlet directed downwardly. This can be accomplished, for example, in the embodiment of FIG. 1 by having the pump mechanism 22 secured to the container 21 against relative rotation about the axis by the container 21 being secured in a friction fit inside the center tube 18 in a desired orientation. Alternatively, there may be some key mechanism between the pump mechanism 22 and the center tube 18 or between the container 21 and the center tube 18 to ensure the pump mechanism 22 is orientated in a desired direction downwardly. The key mechanism may, for example, be provided by suitable configuration of the securing ring 40 as it may engage with the end of the center tube 18 on one hand and the fluid dispenser 14 on the other hand. In the arrangement of FIG. 4, the relative configuration of the male element 45 and the female element 46 may inherently provide for suitable orientation.

The particular nature of the pump mechanism 22 is not limited. The pump mechanism may, for example, comprise a pump for dispensing liquid or a pump for dispensing foam. Suitable foam pumps may have configurations, for example, as disclosed in the applicant's U.S. Pat. No. 7,337,930 although various other pumps of this type may be preferred which can be readily operated disposed horizontally and as are known in the art.

Figure 14:
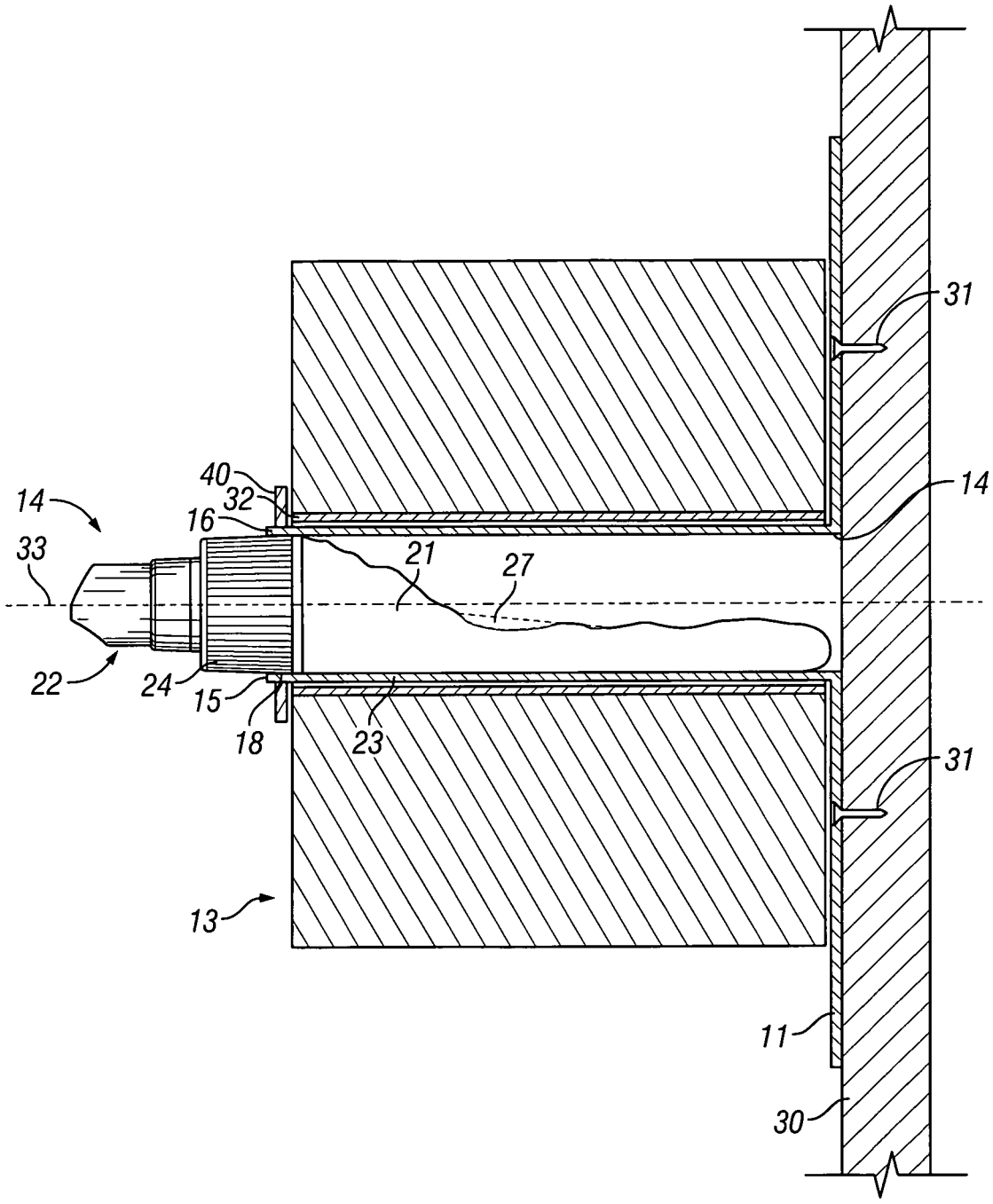
FIG. 14 schematically illustrates a seventh embodiment in accordance with the present invention similar to that of FIGS. 1 to 3, however, with a collapsible container.

The container 21 may comprise either a flexible container or a collapsible container. In this regard, reference is made to FIG. 14 which illustrates a side view similar to that in FIG. 2, however, in which the piston chamber-forming portion 24 of the pump mechanism 14 has a rear portion inside the center tube 18 coupled to the center tube 18, as in a friction fit. The container 21 extends axially from the piston chamber-forming portion 24 as a collapsible container preferably comprising a collapsible, cylindrical plastic bag shown partially collapsed. Such a collapsible container 21 would avoid the need for a dip tube and/or for any arrangement for permitting for vacuum relief, that is, for atmospheric air to enter a rigid container to avoid a vacuum in the container being created which would prevent the dispensing of fluid. With such a collapsible container 21 as the pump mechanism 22, pump mechanisms may be adopted such as those taught in the applicant's U.S. Pat. No. 5,676,277. In FIG. 14, an optional retaining ring 40 is provided to snap fit onto the center tube 18. Alternatively, the retaining ring may be removably or permanently secured to the piston chamber-forming portion 24.

Figure 15:
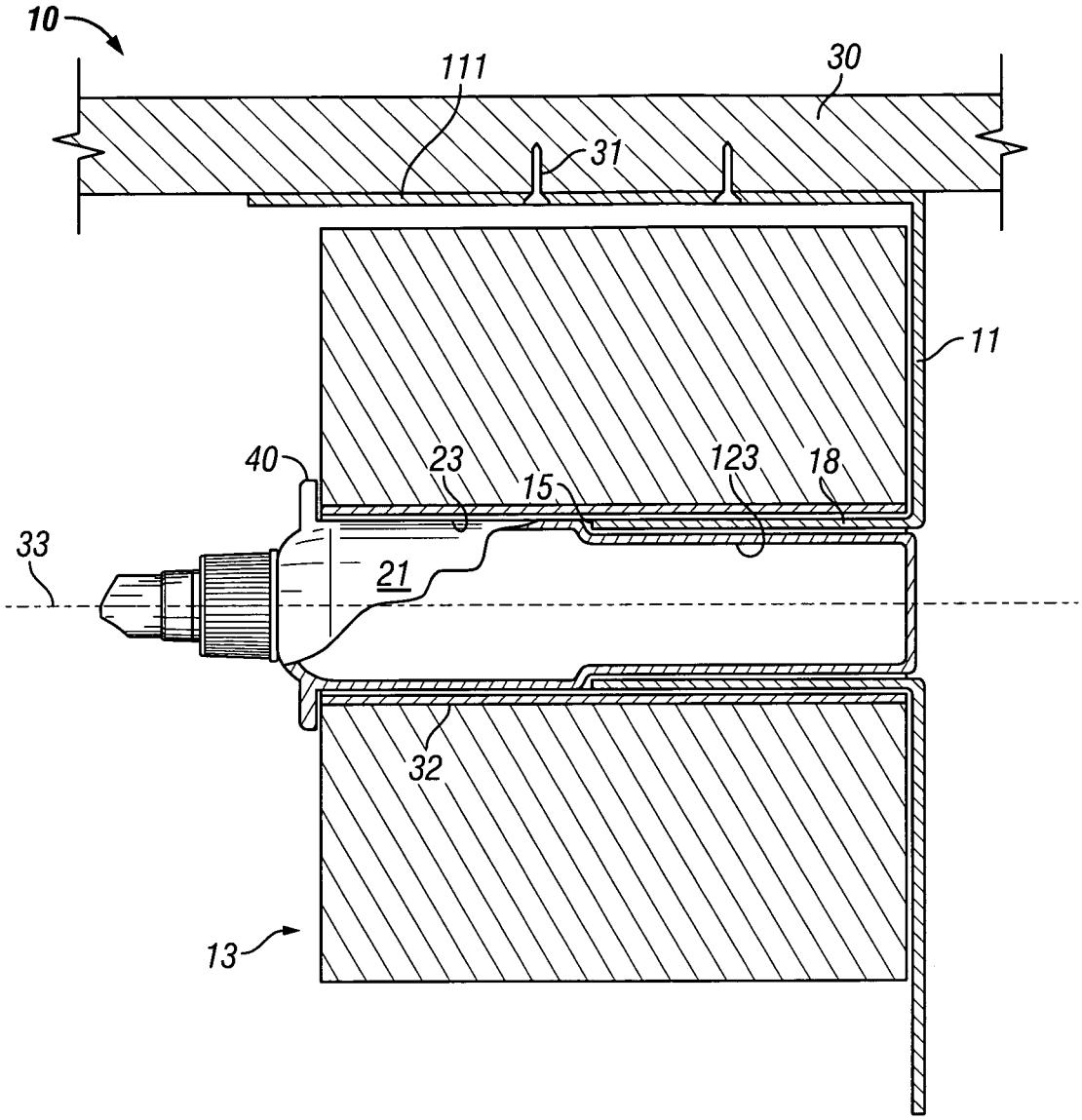
FIG. 15 is a horizontal cross-sectional view of an eighth embodiment of the present invention.

Reference is made to FIG. 15 which shows an eighth embodiment of dispensing apparatus 10 in accordance with the present invention. The embodiment of FIG. 15 has similarities to the embodiment illustrated in FIG. 2 in that a support plate 11 carries a center tube 18 disposed about an axis 33. However, in FIG. 15, the support plate 11 is secured to a depending flange 111 disposed at 90 degrees to the support plate 11 with the depending flange 111 secured to a wall 30 as by screws 31. Thus, in FIG. 11, the axis 33 extends parallel to the surface of the wall 30 rather than perpendicular thereto which was the case with the embodiment illustrated in FIG. 2. FIG. 15 is a cross-sectional view in a horizontal plane. In FIG. 13, the center tube 18 ends at a distal end 15 which does not extend entirely through the roll core 32 of the paper roll 13. The container 21 has an outer generally cylindrical body portion 23 and an inner cylindrical portion 123 with a stepped shoulder therebetween. The inner cylindrical portion 123 is preferably secured inside the center tube 18 as in a friction or bayonet or other fit otherwise against rotation. The cylindrical outer surface of the outer cylindrical portion 23 of the container 21 has the same diameter as the outer surface of the center roll 18 such that the roll core 32 of the paper roll 13 is journalled about both the center tube 18 and the outer cylindrical portion 23 of the container 21. Retaining ring 40 is shown as an integral part of the container 21.

In the embodiments in FIG. 2, the center tube 18 is cylindrical with a cylindrical inner and outer surface and the container 21 has a cylindrical body portion 23. The body portion 23 need not be cylindrical but may be any elongate shape which will fit into the center tube 18. Similarly, the inner surface of the center tube 18 need not be cylindrical.

In the embodiment of FIG. 12, the tube 112 is cylindrical. The tube 112 need not be cylindrical and may comprise any shape which does not interfere with the rolls 13 such as, for example, square or diamond shaped, with the dispenser 14 to have a corresponding shape or other shape which permits the dispenser 14 to be received inside the tube.

While the invention has been described with reference to preferred embodiments, many modification and variations will now occur to a person skilled in the art. For a definition of the invention, reference is made to the following claims.

I claim:

1. A carousel dispenser holding a plurality of toilet paper rolls and a fluid dispenser, the fluid dispenser comprising a container and a pump mechanism with a dispensing outlet, the container having an elongate portion with an outer surface which is cylindrical about a central container axis, the elongate portion having a distal end and a proximal end, the container having an outlet at the distal end, the pump mechanism coupled to the container across the outlet at the distal end, the pump mechanism having an actuator accessible at the distal end of the elongate portion for engagement manually by a user to activate the pump mechanism to dispense fluid from the container out the outlet, the carousel dispenser including a housing, a turntable, a cover and a container mounting mechanism, the turntable mounted to the housing for rotation about a horizontal turntable axis, the cover mounted to the housing locating the turntable between the cover and the housing, the cover movable between a closed position and an open position, the container mounting mechanism securely removably coupling the container to the carousel dispenser with the container axis disposed horizontally coaxial with the turntable axis, the container mounting mechanism engaging the proximal end of the container with the distal end of the container extending away from the container mounting mechanism along the turntable axis, the turntable carrying a plurality of toilet paper roll holders, each of the holders having a support tube disposed about a respective holder axis parallel to the turntable axis, the holders carried on the turntable spaced radially from the turntable axis in a spaced circular array circumferentially spaced from each other, each toilet paper roll comprising an elongate sheet of paper sheet wound about a hollow central cylindrical core, each roll disposed with its core about the support tube of a respective one of the holders with the core journalled for rotation about the respective holder axis, in the closed position the cover enclosing the turntable and rolls carried on the holders on the turntable, the cover movable to the open position in which respective of the rolls can be manually removed from or engaged on the respective holders, the cover having an central opening, when the cover is in the closed position, the fluid dispenser extends along outwardly through the central opening of the cover away from the container mounting mechanism to provide access to the actuator of the pump mechanism by a user axially at the distal end of the container in all rotational positions of the turntable, the cover having a paper access opening radially spaced from the central opening relative the turntable axis, when the cover is in the closed position rotation of the turntable successively moves each holder to a respective rotational position in which the respective roll carried on that holder is accessible for engagement by a user and the respective rolls on the other holders are not accessible for engagement by a user.

2. A carousel dispenser as claimed in claim 1, wherein the container mounting mechanism comprises a cylindrical tube member coupled to the carousel dispenser disposed coaxially about the turntable axis, the elongate portion of the container coaxially received within the tube member.

3. A carousel dispenser as claimed in claim 2, wherein the tube member has an open forward end, the fluid dispenser when engaged in the tube member extends forwardly from the open forward end of the tube member presenting the actuator of the pump mechanism forwardly axially at the open forward end of the tube member.

4. A carousel dispenser as claimed in claim 3 wherein:

the fluid dispenser is removable the tube member by relative sliding of the fluid dispenser forwardly through the open forward end of the tube member and the fluid dispenser is insertable into the tube member by relative sliding of the fluid dispenser rearwardly through the open forward end of the tube member.

5. A carousel dispenser as claimed in claim 4 wherein, the tube member is carried on the turntable rotatable therewith, the container is journalled in the tube member for rotation about the container axis relative the turntable.

6. A carousel dispenser as claimed in claim 5 wherein each support tube of each of the holders has a forward distal end and a proximal end, the proximal end of each support tube is secured to the turntable.

7. A carousel dispenser as claimed in claim 6 wherein:

each roll is removable from the respective support tube by relative sliding of the roll forwardly on the support tube and each roll is insertable onto the respective support tube by relative sliding of the roll rearwardly over the forward distal end of the support tube.

8. A carousel dispenser as claimed in claim 1 wherein each support tube of each of the holders has a forward distal end and a proximal end, the proximal end of each support tube is secured to the turntable.

9. A carousel dispenser as claimed in claim 8 wherein:

each roll is removable from the respective support tube by relative sliding of the roll forwardly on the support tube and each roll is insertable onto the support tube by relative sliding of the roll rearwardly over the forward distal end of the support tube.

10. A carousel dispenser as claimed in claim 1 wherein:

when the cover is in the closed position, engagement between the cover and the fluid dispenser prevents removal of the fluid dispenser from the container mounting mechanism, and when the cover is in the closed position the fluid dispenser is accessible for manual engagement by a user for removal.

11. A carousel dispenser as claimed in claim 5 wherein:

when the cover is in the closed position, engagement between the cover and the fluid dispenser prevents removal of the fluid dispenser from the container mounting mechanism, and when the cover is in the closed position the fluid dispenser is accessible for manual engagement by a user for removal by manual sliding forwardly through the open forward end of the tube member.

12. A carousel dispenser as claimed in claim 7 wherein the turntable comprises a support member with a forward surface normal to the turntable axis, the tube member secured to the support member and extending forwardly therefrom to the open forward end of the tube member, the support tube of each of the holders is secured to the support member at its proximal end and extends forwardly there from to its forward distal end.

* * * * *